US006164231A

United States Patent [19]

Shimmell et al.

[11] Patent Number: 6,164,231

[45] Date of Patent: Dec. 26, 2000

[54] INSERT FOR MARINE FITTING

[76] Inventors: Dennis S. Shimmell, 3383 Harrison St., Hudsonville, Mich. 49426; Dennis S. Shimmell, Jr., 1411 Gentian Dr., SE., Kentwood, Mich. 49508

[21] Appl. No.: 09/267,104

[22] Filed: Mar. 12, 1999

[51] Int. Cl.[7] ..... B63B 19/26

[52] U.S. Cl. ..... 114/182; 141/86

[58] Field of Search ..... 114/221 R, 182, 114/192, 343; 141/86, 88

[56] References Cited

U.S. PATENT DOCUMENTS

| | | | |
|---|---|---|---|
| 2,555,868 | 6/1951 | Bowman | 141/86 |
| 4,082,125 | 4/1978 | Wilson et al. | 141/86 |
| 4,817,691 | 4/1989 | Lau | 141/86 |
| 4,862,822 | 9/1989 | Michalowski | 114/364 |
| 5,722,339 | 3/1998 | Gross | 114/182 |
| 5,850,858 | 12/1998 | Ziegler | 141/86 |

*Primary Examiner*—Jesus D. Sotelo
*Attorney, Agent, or Firm*—Warner Norcross & Judd LLP

[57] ABSTRACT

An insert for a marine thru-hull fitting. The insert includes an annular body and an outwardly extending lip. The annular body is adapted to fit closely around the throat of the thru-hull fitting so that the insert can be sandwiched between the flange of the fitting and the hull of the vessel. The lip extends outwardly from the bottom of the body to direct liquid flowing down the fitting away from the hull of the vessel.

27 Claims, 3 Drawing Sheets

INSERT FOR MARINE FITTING

BACKGROUND OF THE INVENTION

The present invention relates to marine accessories, and more particularly to accessories for marine thru-hull fittings.

Many boats, ships and other marine vessels are provided with thru-hull fittings that allow water or other liquids to vent from inside of the hull to the environment. For example, thru-hull fittings are used to discharge water or other liquids through the hull from a variety of appliances, including air conditioners, bilge pumps, live wells and other apparatus. Thru-hull fittings are also used to drain water from various collection points throughout the boat, such as the cockpit deck, engine cover gutter and anchor locker as well as to vent condensation from holding tanks and the like. Thru-hull fittings are available in a wide variety of designs. FIG. 1 is a sectional view of a conventional thru-hull fitting 100 adapted to vent water received from a discharge hose 130. The discharge hose 130 may serve as a discharge line for an appliance or as a drainage line for a water collection point. Thru-hull fitting 100 includes a flange 104 that engages the outer surface 122 of the hull 120 and a throat 102 that extends from the flange 104 into the interior of the hull. The outer surface of the throat 102 is threaded and receives lock nut 110. The lock nut 110 is tightened against the hull to secure the fitting. FIG. 2 is a sectional view of second type of thru-hull fitting 100' adapted to form a passageway through the hull 120, but not to receive a discharge hose. This type of fitting is often used as a drainage for water collection points located immediately adjacent to the hull. As shown, the throat 102' of this fitting 100' is much shorter in length and the lock nut 110 is replaced by an internally threaded flange 111.

A well-known problem associated with the use of thru-hull fittings is the formation of stains on the outer surface of the hull caused by minerals and other solids contained in the discharged liquid. Thru-hull fittings are typically used to discharge liquids, such as river water, lake water, brackish water and salt water, that contain at least some degree of suspended minerals and other solids. As relatively slow moving liquid is discharged from the fitting, it runs down the outer surface of the hull to the water line. The minerals and other solids contained in the liquid adhere to the surface of the hull leaving stains in a relatively short period of time. Experience has revealed that these stains are often difficult to remove, and a variety of chemical products (e.g. cleaning detergents) and mechanical products (e.g. cleaning brushes and scouring pads) are available on the market to help remove the stains.

U.S. Pat. No. 5,722,339 to Gross is directed to a thru-hull fitting that is modified in an effort to reduce the amount of discharge liquid running along the outer surface of the hull. The Gross patent discloses a thru-hull fitting with an outer flange that is design to separate the discharge liquid from the hull. The Gross flange includes a planar and substantially vertical outer surface and an inclined inner surface. The discharge liquid flows down the outer surface to the bottom edge of the fitting. The inclined inner surface is intended to inhibit the flow of liquid from the outer surface, along the bottom edge and back toward the hull. The Gross thru-hull fitting suffers in several respects. First, in retrofitting applications, the Gross thru-hull fitting requires replacement of the entire thru-hull fitting. Manufacture of an entirely new thru-hull fitting is relatively expensive and creates problems associated with the disposal or recycling of the replaced fittings.

Second, because drip control fittings are not desired in many applications, two entire lines of thru-hull fittings must be manufactured and stocked—one line with drip control flanges and one without. Because thru-hull fittings are available in such a wide variety of styles, shapes and sizes, this is a significant undertaking. Obviously, this increases the overall cost of manufacturing and stocking thru-hull fittings.

Third, as a result of adhesion, the Gross thru-hull fitting may still permit discharge water to flow along the outer surface of the hull. Because of the adhesive and cohesive characteristics of water, discharge liquids have a tendency to adhere or cling to the surface of the thru-hull fitting. Adhesion is a well-known phenomenon that, in effect, creates a force on the liquid directed toward the surface along which it is flowing. In this case, the adhesive force resists separation of the discharge liquid from the fitting—even at the fitting's bottom edge. As sufficiently slow moving liquid reaches the bottom edge of the fitting, adhesion causes the liquid to cling to and roll under the bottom edge of the fitting. The adhesive force is eventually overcome by gravity, but, in the case of sufficiently slow moving liquid, not before it has redirected the flow of liquid inwardly toward the hull. As a result, sufficiently slow moving water may still flow along and stain the outer surface of the hull.

SUMMARY OF THE INVENTION

The aforementioned problems are overcome by the present invention wherein a thru-hull fitting insert is provided with an outwardly inclined lip. The insert is adapted to fit between the hull and the flange of an existing thru-hull fitting. The outwardly inclined lip provides an outwardly directed force on the liquid that counteracts the effects of adhesion to significantly reduce the likelihood of discharged liquids flowing along the outer surface of the hull.

In the preferred embodiment, the insert includes an annular body and an outwardly inclined lip. The annular body is adapted to fit closely around the throat of the fitting and to extend flush with the circumferential edge of the flange. The lip preferably extends outwardly from the bottom of the annular body up to, but not beyond, the outermost extent of the thru-hull fitting. The bottom edge of the lip is also preferably thin to reduce adhesion by reducing the contact area between the liquid and the insert at the bottom edge of the lip.

In another preferred embodiment, the insert is manufactured from a pliable, resilient material that permits the insert to function as a gasket and to flex under impact.

The present invention provides a simple and effective insert that can significantly reduce, if not eliminate, hull stains caused by liquid discharged through thru-hull fittings. The insert is easily installed as part of OEM thru-hull fittings or on existing thru-hull fittings, thereby eliminating the need to replace the entire fitting. When manufactured from pliable, resilient materials, the insert will readily flex under impact and does not require the use of sealants during installation. Further, the insert is inexpensively manufactured and stocked in a wide variety of sizes to fit with virtually any thru-hull fitting.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
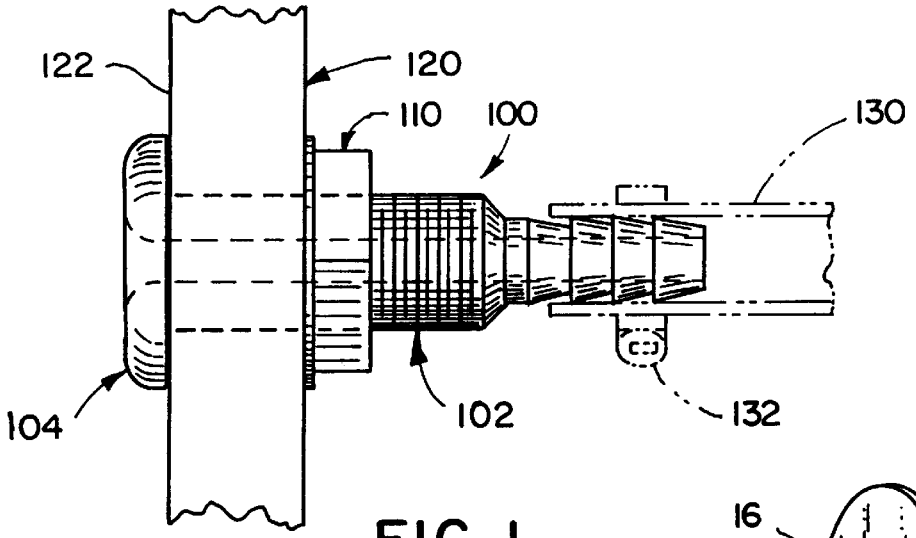
FIG. 1 is a sectional view of a portion of a hull showing a first prior art thru-hull fitting.
Figure 3:
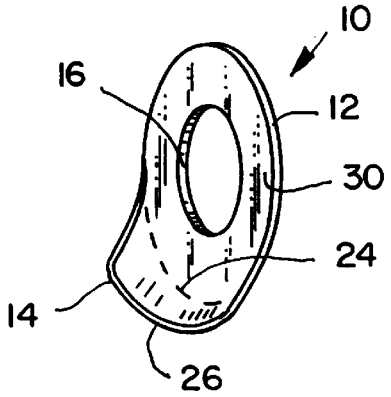
FIG. 3 is a perspective view of an insert according to a preferred embodiment of the present invention.
Figure 2:
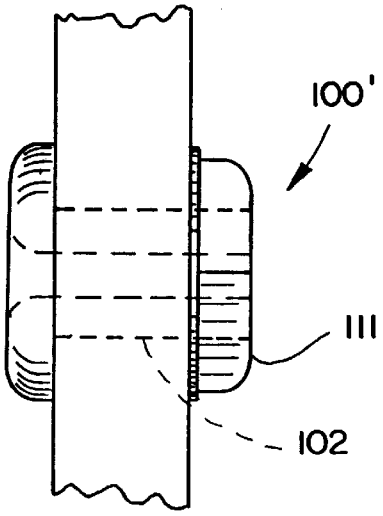
FIG. 2 is a sectional view of a portion of a hull showing a second prior art thru-hull fitting.
Figure 4:
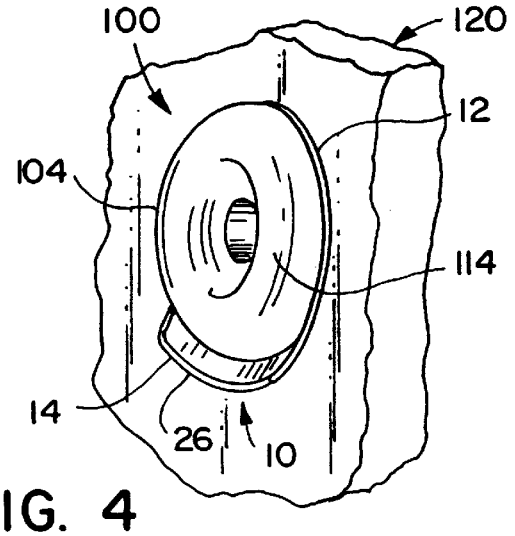
FIG. 4 is a perspective view of a portion of a hull showing the insert installed behind a thru-hull fitting.

An insert manufactured in accordance with a preferred embodiment of the present invention is illustrated in FIG. 3, and generally designated 10. As shown in FIG. 4, the insert 10 is adapted to be fitted to a conventional thru-hull fitting 100 between the flange 104 and the hull 120 of the vessel. The insert 10 includes an outwardly inclined lip 14 that directs discharged liquids away from the hull 120 to reduce, if not eliminate, hull stains associated with liquid discharge. Thru-hull fittings are available in a variety sizes, such as ⅝, 3/4, 1, 1½ and 2 inch diameter, and styles, such as straight and right angle. For purposes of disclosure, the present invention is described in connection with a conventional ¾ inch diameter, straight thru-hull fitting that is adapted to receive a discharge or drainage hose (see FIG. 5). The present invention is, however, well suited or readily adapted for use with virtually any other size or style of thru-hull fittings.

Figure 5:
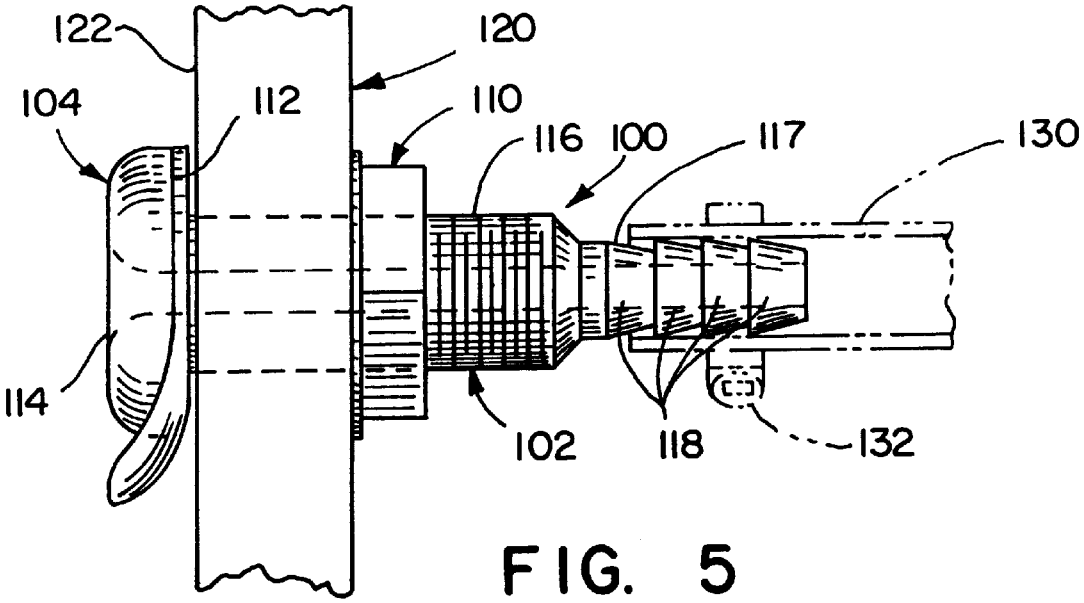
FIG. 5 is a sectional view of a portion of the hull taken along line III—III of FIG. 4.

Referring now to FIG. 5, the exemplary thru-hull fitting 100 includes a tubular throat 102 and a flange 104. The flange 104 includes a substantially planar inner surface 112 that, in the absence of insert 10, would normally engage the outer surface 122 of the hull 120 and a contoured outer surface 114. The outer surface 114 of the flange 104 is curved to provide a smooth transition between the hull 120 and the fitting 100. The tubular throat 102 extends from the flange 104 through the hull 120 and into the interior of the vessel. The exterior of the throat 102 includes a threaded portion 116 that threadedly receives a lock nut 110. The lock nut 110 is tightened against the hull 120 to secure the fitting 100 in place. The throat 102 includes a reduced diameter portion 117 having a plurality of hose barbs 118 adapted to receive a ⅝ inch discharge or drainage hose 130. The hose 130 is preferably secured to the throat 102 by a conventional hose clamp 132.

Figure 6:
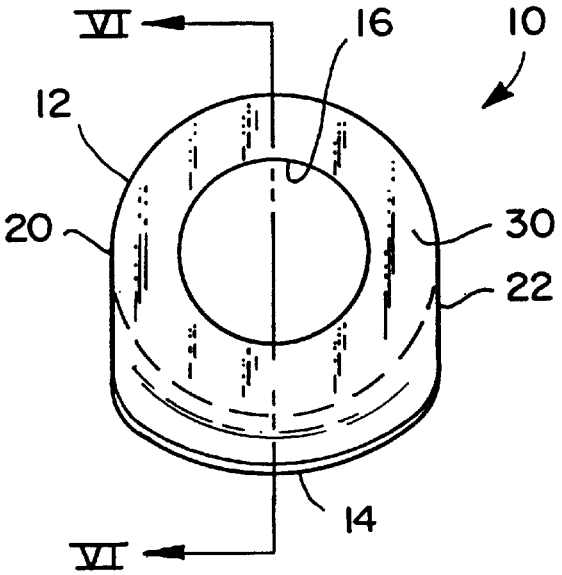
FIG. 6 is a front plan view of the insert.
Figure 7:
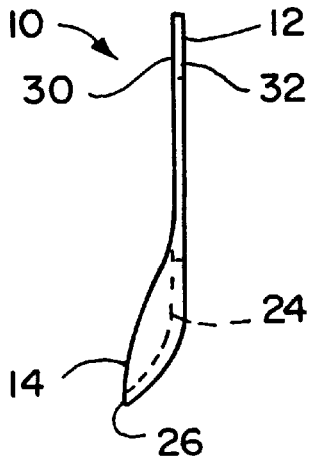
FIG. 7 is a side elevational view of the insert.
Figure 8:
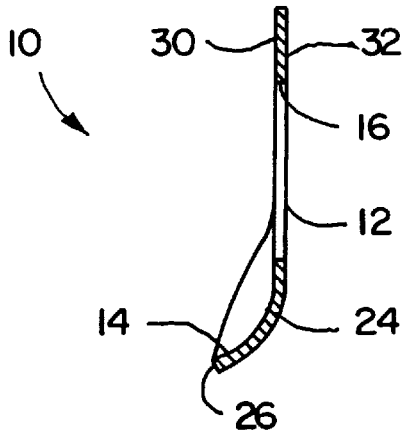
FIG. 8 is a sectional view of the insert taken along line VI—VI of FIG. 6.

Referring now to FIGS. 6–8, the insert 10 includes an annular body 12 and a lip 14 extending outwardly at an angle from the body 12. The annular body 12 includes inner and outer surfaces, 30 and 32 respectively, and defines a concentric, circular opening 16 adapted to closely fit over the throat 102 of the fitting 100. The diameter of this opening 16 will vary from application to application depending on the outer diameter of the throat 102, but in the preferred embodiment is approximately 0.76 inch. The outer diameter of the body 12 corresponds with the outer diameter of the flange 104 of the fitting 100, which in the preferred embodiment is approximately 1.5 inches. This provides flush alignment between the insert 10 and the fitting 100. If desired, the outer surface 32 of the body can include knurling, score lines or the like (not shown) to engage the inner surface 105 of the flange 104 and resist rotation of the insert 10 with respect to the fitting 100. This will reduce the likelihood of the insert 10 rotating out of alignment with the fitting 100.

The shape of the lip 14 is relatively complex. The lip 14 extends outwardly at an angle from the bottom portion of the body 12. In the preferred embodiment, the lip 14 extends at an angle of approximately 57 degrees from the body 12, but it is anticipated that angles ranging from at least 20 to 70 degrees will provide acceptable results. Further, the lip 14 preferably extends outwardly from the annular body 12 up to, but not beyond, the outermost extent of the flange 104. As a result, the insert 10 does not protrude beyond the flange 104 where it might have an increased chance of catching on and/or being damaged by foreign objects, such as dock supports, boat covers and the like. In the preferred embodiment, the perpendicular distance between the bottom edge 26 of the lip 14 and the plane defined by the inner surface 30 of the body 12 is approximately 0.30 inch. As perhaps best shown in FIG. 6, the left side 20 and right side 22 of the lip 14 preferably extend along substantially vertical lines that are tangent to the circumferential edge of the body 12. Accordingly, the lip 14 does not extend laterally beyond the edges of the flange 104. As a result, the width of the lip 14 does not exceed the width of the thru-hull fitting, making it less likely to catch on and/or be damages by foreign objects. The lip 14 is joined to the body 12 by a curved portion 24 having a radius of approximately 1/16 inch. The bottom edge 26 of the lip 14 is curved with a radius of approximately 1.38 inches. The bottom edge 26 curves smoothly into the side edges 20 and 22 along a radius of approximately 0.5 inch. In the preferred embodiment, the bottom edge 26 of the lip 14 is relatively thin (i.e. 0.054 inch) to reduce the contact area between the liquid and the insert 10 as the liquid reaches the bottom edge 26. This reduces adhesion, thereby facilitating detachment of liquid from the lip 14.

The insert 10 can be manufactured from a variety of materials. For example, the insert 10 can be manufactured from any of a variety of well-known metals or metal alloys, such as bronze, brass, stainless steel, steel, aluminum, etc. If desired, the insert 10 can be plated with chrome or other desired materials to protect the insert 10 and/or improve its aesthetic appearance. The metal should be of sufficient thickness and hardness to offer significant resistance to deformation of the lip 14. The lip 14 should, however, deform under forces large enough to potentially damage the hull. This deformation may absorb some of the forces and help to protect the hull from damage caused by an impact against the lip 14. Alternatively, the insert 10 can be manufactured from a flexible and resilient material, such as a plastic or polymeric material. The flexible and resilient material should be selected to permit the insert 10 to flex under significant forces and return to the desired shape when the force is removed. This material may also be selected with sufficient softness or pliability to permit the insert 10 to function as its own gasket, thereby eliminating the need to apply sealant when installing the insert 10. One of ordinary skill in the art will readily appreciate and recognize various material formulations, including appropriate softeners and other additives, that satisfy these criteria.

Manufacture and Installation

The insert 10 is manufactured using conventional techniques and apparatus. For example, if the insert 10 is manufactured from metal, the insert 10 can be manufactured using conventional stamping or casting operations and conventional stamping or casting machinery. Alternatively, if the insert 10 is manufactured from a plastic material, the insert 10 can be manufactured using conventional injection molding or vacuum forming techniques and apparatus.

The insert 10 is easily installed in a series of simple steps. First, any hose 130 attached to the thru-hull fitting 100 is removed by loosening the hose clamp 132 and pulling the hose 130 off of the hose barbs 118. Next, the thru-hull fitting 100 is removed from the hull 120 by loosening and removing lock nut 110. The fitting 100 is then be easily removed from the hull 120. Any old gasket material located on the inner surface 112 of the flange 104 or the outer surface 122 of the hull 120 is then removed. The insert 10 is next fitted over the throat 102 of the fitting 100. A layer of conventional sealant or marine caulking is applied to the inner surface 30 and outer surface 32 of the body 12, either before or afer the insert 10 is fitted over the throat 102. If the insert 10 is manufactured from a sufficiently soft or pliable material, sealant will not be necessary. The insert 10 is then reinstalled in the hull 102, by pushing the throat 102 back through the hull 120 and reattaching lock nut 110. The insert 10 should be oriented with the lip 14 extending downwardly from the body 12 before the lock nut 110 is tightened. Finally, the hose 30 is reattached.

Figure 9:
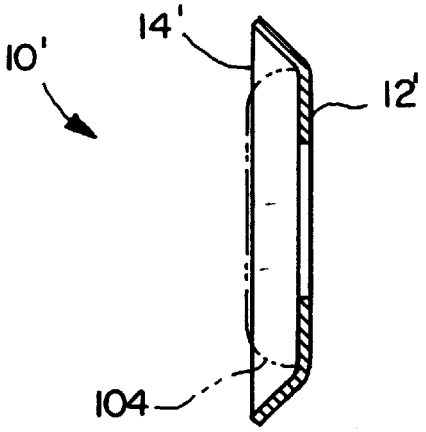
FIG. 9 is a sectional view similar to FIG. 8 of an alternative insert having a circumferential flange.

An alternative embodiment of the present invention is disclosed in FIG. 9. In this embodiment, the insert 10' includes a lip 14' extending around the entire circumference of the body 12'. With this embodiment, it is unnecessary to ensure proper rotational alignment between the insert 10' and fitting 100. As with the preferred embodiment described above, the lip 14' preferably extends outwardly up to, but not beyond the outermost extent of the flange 104 (shown in phantom lines). This embodiment is installed in essentially the same manner as the above described preferred embodiment.

Figure 10:
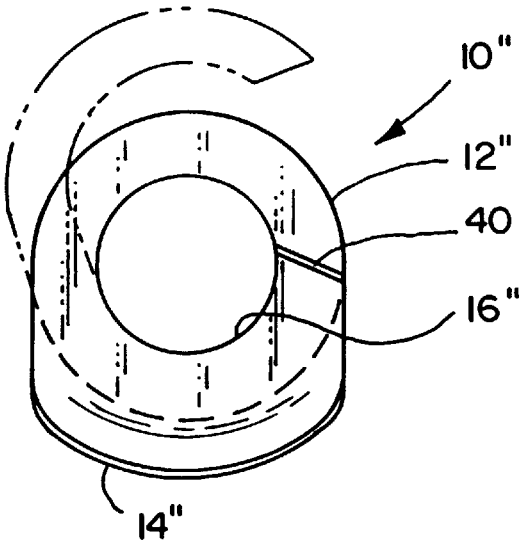
FIG. 10 is a front plan view of a second alternative insert that is split to facilitate installation.

A second alternative embodiment is shown in FIG. 10. In this embodiment, the insert 10" is manufactured from a flexible, resilient material. The material has sufficient softness or pliability to permit the insert 10" to function as its own gasket. The body 12" includes a split 40 that permits the insert 10" to be flexed or spread open during installation (shown in phantom lines). This permits the insert 10" to be installed on the fitting 100 without removing the fitting 100 from the hull 120. Instead, the fitting 100 is loosened to create a gap between the flange 104 and the hull 120 that is at least wide enough to receive the insert 10". The insert 10" is then spread open at slit 40 and fitted over the throat 102 of the fitting 100. The insert 10" is then released allowing it to return to its original shape entrapping the throat 102 of the insert 10". The lock nut 110 is then tighten to secure the fitting 100 and insert 10". The split 40 preferably extends at a downward angle through a side portion of the body 12". This reduces the likelihood of any liquid leaking into the hull 120 along the split 40. If desired, a small amount of sealant can be applied to the split 40 during installation before the lock not 110 is tightened.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. An insert for a thru-hull fitting having a throat and a flange comprising:

an annular body defining a plane and an opening adapted to be fitted over the throat of the thru-hull fitting;

a lip extending from said body, said lip extending outwardly and downwardly from said body at an angle to said plane to define a inclined surface which redirects liquid flowing from the fitting onto said lip.

2. The insert of claim 1 wherein said lip is adapted to extend outwardly to, but not beyond, an outermost extent of the flange of the thru-hull fitting.

3. The insert of claim 2 wherein said body includes an outer diameter substantially identical to an outer diameter of the flange of the thru-hull fitting.

4. The insert of claim 3 wherein said lip is adapted to extend outwardly to, but not beyond, a lateral extent of the flange of the thru-hull fitting.

5. The insert of claim 4 wherein said angle is between approximately 20 degrees and 70 degrees.

6. The insert of claim 5 wherein said insert is manufactured from a flexible and resilient material permitting said insert to flex under impact.

7. The insert of claim 6 wherein said insert is manufactured from a soft and pliable material permitting said insert to function as its own gasket.

8. The insert of claim 6 wherein said body defines split permitting said insert to be fitted over the fitting during installation.

9. The insert of claim 8 wherein said split extends at an angle through a side portion of said body.

10. A combination comprising:

a thru-hull fitting including a flange adapted to engage a hull of a vessel and a throat adapted to extend from said flange through the hull into the vessel;

an insert fitted over said throat adjacent to said flange, said insert including a body and a lip extending from body, said body defining an opening fitted closely over said throat, said lip extending outwardly and downwardly from said body to define a inclined surface disposed beneath said flange.

11. The combination of claim 10 wherein said flange includes an outermost extent, said lip extend outwardly to, but not beyond, said outermost extent of said flange.

12. The combination of claim 11 wherein said flange includes left and right lateral extents, said lip extending outwardly to, but not beyond, said lateral extents of said flange.

13. The combination of claim 12 wherein said flange includes an outer diameter, said body including an outer diameter substantially identical to said outer diameter of said flange.

14. The combination of claim 13 wherein said lip extends downwardly and outwardly from said body at an angle between approximately 20 degrees and 70 degrees.

15. The combination of claim 14 wherein said insert is manufactured from a flexible and resilient material permitting said insert to flex under impact.

16. The combination of claim 15 wherein said insert is manufactured from a soft and pliable material permitting said insert to function as its own gasket.

17. The combination of claim 15 wherein said body defines split permitting said insert to be fitted over the fitting during installation.

18. The combination of claim 17 wherein said split extends at an angle through a side portion of said body.

19. The combination of claim 10 wherein said body includes a peripheral edge, said lip extending entirely around said periphery.

20. A method of using an insert with a thru-hull fitting, comprising the steps of:

providing an insert having a flange adapted to engage a hull of a vessel and a throat adapted to extend from the flange through the hull into the vessel;

providing an insert with a body and a lip, the body defining an opening adapted to fit over a throat of the thru-hull fitting, the lip extending downwardly and outwardly from the body; and installing the insert between the flange and the hull of the vessel, the opening fitted over the throat of the fitting with the lip oriented substantially below the flange.

21. The method of claim 20 wherein the lip extends at an angle to the body of between approximately 20 and 70 degrees.

22. The method of claim 21 wherein the flange and the body each include an outer edge, said installing step including aligning the insert and the fitting with the outer edge of the body being substantially flush with the outer edge of the flange.

23. The method of claim 22 wherein the outer edge of the body and the outer edge of the flange are circumferential and have substantially the same diameter, said aligning step including coaxially aligning the body and the flange.

24. The method of claim 23 wherein said installing step includes sealing the insert against the flange and the hull.

25. The method of claim 24 wherein said sealing step includes applying a sealant to an inner and an outer surface of the body.

26. The method of claim 25 wherein the insert is manufactured from a soft, pliable material permitting the insert to function as a gasket, said sealing step including firmly compressing the body between the flange and the hull.

27. The method of claim 26 wherein the body defines a split, said installing step including spreading the body at the split and fitting the body laterally over the throat.

* * * * *